US009161640B2

(12) United States Patent
Široký et al.

(10) Patent No.: US 9,161,640 B2
(45) Date of Patent: Oct. 20, 2015

(54) BLANKET AND BLANKET COVER

(71) Applicant: HOLEY QUILT, s.r.o., Bratislava (SK)

(72) Inventors: Igor Široký, Prievidza (SK); Miroslav Lacko, Prievidza (SK)

(73) Assignee: HOLEY QUILT, S.R.O. (SK)

( * ) Notice: Subject to any disclaimer, the term of this patent is extended or adjusted under 35 U.S.C. 154(b) by 0 days.

(21) Appl. No.: 14/483,531

(22) Filed: Sep. 11, 2014

(65) Prior Publication Data

US 2015/0082540 A1 Mar. 26, 2015

(30) Foreign Application Priority Data

Sep. 20, 2013 (SK) ..... 50111-2013 U

(51) Int. Cl.
*A47G 9/02* (2006.01)
*A47G 9/04* (2006.01)

(52) U.S. Cl.
CPC ..... *A47G 9/0223* (2013.01); *A47G 9/0207* (2013.01); *A47G 9/0261* (2013.01); *A47G 9/04* (2013.01)

(58) Field of Classification Search
CPC ... A47G 9/0207; A47G 9/0223; A47G 9/023; A47G 9/0261
USPC ..... 5/482, 486, 501, 502
See application file for complete search history.

(56) References Cited

U.S. PATENT DOCUMENTS

| | | | | |
|---|---|---|---|---|
| 2,711,546 | A * | 6/1955 | Licht | 5/485 |
| 4,062,076 | A * | 12/1977 | Albertson | 5/482 |
| 4,441,223 | A * | 4/1984 | Yang | 5/494 |
| 5,432,965 | A * | 7/1995 | Espinoza | 5/482 |
| 5,933,886 | A * | 8/1999 | Washington | 5/494 |
| 6,640,362 | B1 * | 11/2003 | Kimball | 5/482 |
| 7,975,334 | B1 | 7/2011 | Vensel | 5/498 |
| 2005/0273930 | A1 | 12/2005 | Phillipps | 5/486 |
| 2008/0250560 | A1 * | 10/2008 | Armstrong | 5/485 |
| 2012/0060282 | A1 | 3/2012 | Medici | 5/495 |
| 2013/0014326 | A1 | 1/2013 | Kane et al. | 5/482 |

FOREIGN PATENT DOCUMENTS

| | | |
|---|---|---|
| CZ | 24795 U1 | 1/2013 |
| GB | 2 225 717 A | 6/1990 |

OTHER PUBLICATIONS

Search Report issued Jul. 23, 2014 in corresponding Slovak Patent Application No. 50111-2013, along with an English language translation thereof.

* cited by examiner

*Primary Examiner* — Michael Trettel
(74) *Attorney, Agent, or Firm* — Ostrolenk Faber LLP

(57) ABSTRACT

Blanket with protective effect against dorsal parts of the human body becoming cold during sleep, with a composition of two textile layers (11, 11') of the same size and shape that are equipped with identically located prolonged openings (2, 2') of the same size and shape that are mutually firmly connected alongside their perimeters (3) and alongside the perimeter of the opening (4). A blanket cover is described, too, consisting of two textile layers of the same size and shape equipped with identically located prolonged openings of the same size and shape.

4 Claims, 2 Drawing Sheets

BLANKET AND BLANKET COVER

CROSS-REFERENCE TO RELATED APPLICATIONS

The present application claims priority to Slovak Utility Model Application No. PUV 50111-2013, filed Sep. 20, 2013, the disclosure of which is incorporated herein by reference.

TECHNICAL FIELD OF THE INVENTION

The technical solution concerns a blanket with a protective effect mainly against dorsal parts of the human body becoming cold during sleep.

BACKGROUND OF THE INVENTION

As a result of increased occurrence of civilization diseases, the quality of human sleep is deemed very important. In addition to methods of exercise and various physical activities, the sleep-quality-oriented industry is successfully growing. It is focused not only on the quality of beds themselves and their equipment, and the quality and composition of used mattresses, but also on the quality of materials used in the manufacture of blankets, pads and bed linen.

SUMMARY OF THE INVENTION

It was found that, even when complying with the maximum comfort and quality in bed equipment, neurological symptoms can occur as a result of the behaviour of the sleeping person, and/or internal medical problems, as a result of cold of dorsal parts of the human body. This cold is caused by exposure of the dorsal part of the body, during subconscious manipulation of the blanket as we currently know it, mainly due to the fact that the sleeping person that lies on his side, places his leg on the blanket, exposing in this way the dorsal part of his body or part thereof.

These deficiencies are solved by a blanket according to the technical solution, which consists of two outer layers of textile. The layers have the same size and shape and they are firmly connected at their perimeter. The subject matter of the technical solution consists in the fact that both layers are provided with a prolonged opening of the same size and shape with the same location, both layers being mutually firmly connected also alongside the prolonged opening, too. Suitable size of the opening is in the range of 50 to 70% of the total length of the blanket. It is appropriate if the opening is narrow.

According to a particular sleeping culture that can differ in different countries and that is also subject to specific temperature conditions, the blanket as described above, can be sufficient. Well known by us, too, another sleeping culture requires better thermal insulation function of the blanket. In such a case, placing at least one thermal insulation layer is advantageous, between the outer layers, which would have the same shape and the same location of the prolonged opening as the outer layers. All layers are then connected to each other on the circumference and on the circumference of the prolonged opening. Mutual connection of the outer textile layers and the internal thermal insulation layer further is advantageous, too, using grafting patterns of regular or irregular shape.

The blanket according to the technical solution can have various material composition. For instance, the outer textile layers may have fibre woven in, which is sprayed by carbon coating, or microcapsules sewn directly in the fibres, with extracts of Aloe Vera cactus. Outer textile layers may be made of natural bamboo fiber combined with microfiber. Outer textile layers may be made of combed cotton with fine fiber of permanently lustrous fabric with satin weave or they can be made of synthetic fibres resistant to high temperatures. Fine polyester fibres so-called microfiber micro-phase is another suitable material. Outer textile layers may be for instance, woven from cotton seed fibres.

The inner heat insulating layer can be suitably made of hollow polyester fiber. Hollow fiber belongs to the group of profiled fibres. Special profiled nozzles are used for spinning, with the possibility to regulate the size of the cavity, or possibly even the number of cavities in the fiber. The cavity in the fiber affects the thermal insulation properties. The inner thermal insulation layer can be made of siliconised fiber, for better adaptation to the body and more effective insulation, or it can be filled with spherical fiber. The inner thermal insulation layer can be made of microfiber or fluff, or feather.

According to the particular culture of sleep, the blanket according to the technical solution can be used with cover, due to hygienic consideration.

Hence, the technical solution further concerns blanket cover, too, which consists of two textile layers of the same size and shape, firmly joined together around the perimeter. Each of the two layers is provided with identically located prolonged opening of the same size and shape. The prolonged openings of the both textile layers are equipped with trimming on their inner sides, with connecting mechanism that mutually connects the above opening of the textile layers or that connect own openings of each of the above textile layers. This opening on the both textile layers of the cover serves also for putting on the bed blanket cover. The following are examples of the connecting mechanisms that are located along sides of the prolonged opening that is located in the middle of the both textile layers: pair of slits and buttons; zips; rivets or hook and loop fasteners commonly sold under the trademark VELCRO; etc.

As an example, both textile layers of the blanket can be equipped from the following materials. cotton; damask; cotton satin; flannel; microfiber; silk; knitwear material, according to individual taste of the user.

When using the blanket according to the technical solution either put in a cover or not, the user with a habit of sleep on his side will usually put his knee and part of his leg through the prolonged opening and his dorsal part will remain sufficiently covered. When changing his position to the other side, legs are exchanged. Experiments showed that when sleeping under such cover, the corresponding movement habit arises very quickly.

The cover according to the technical solution can by used for overall coverage of the blanket. In such a case the prolonged opening shall not be used. In such a case the connecting mechanism connects own opening of each textile layer.

BRIEF DESCRIPTION OF THE DRAWINGS

The technical solution will be illustrated using enclosed drawings, as follows.

DESCRIPTION OF EMBODIMENTS

Example 1

Figure 1:
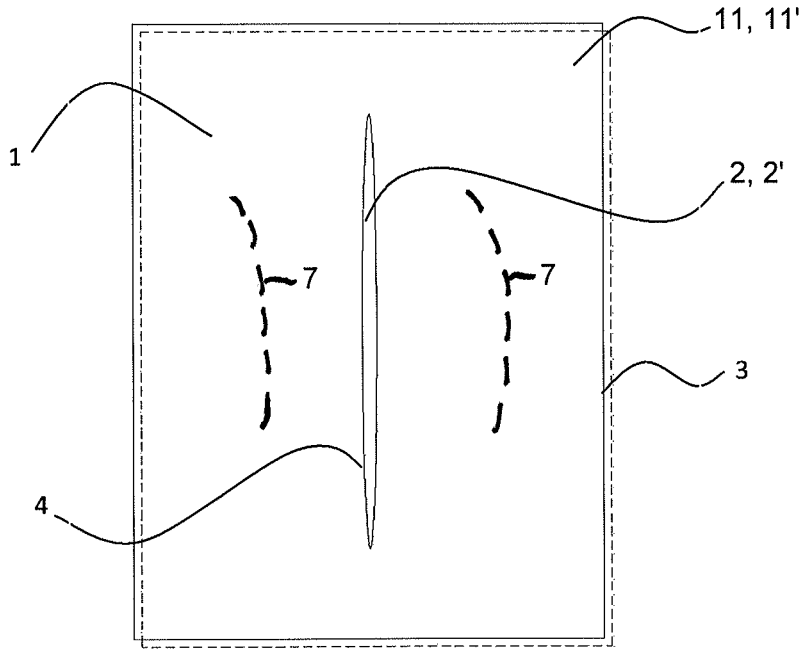
FIG. 1 shows a front view of the blanket with reference numerals of elements in the rear view of the blanket, which are identical to elements in the front view of the blanket, being indicated by the same reference numeral as elements in the front view, but with a prime thereafter.
Figure 2:
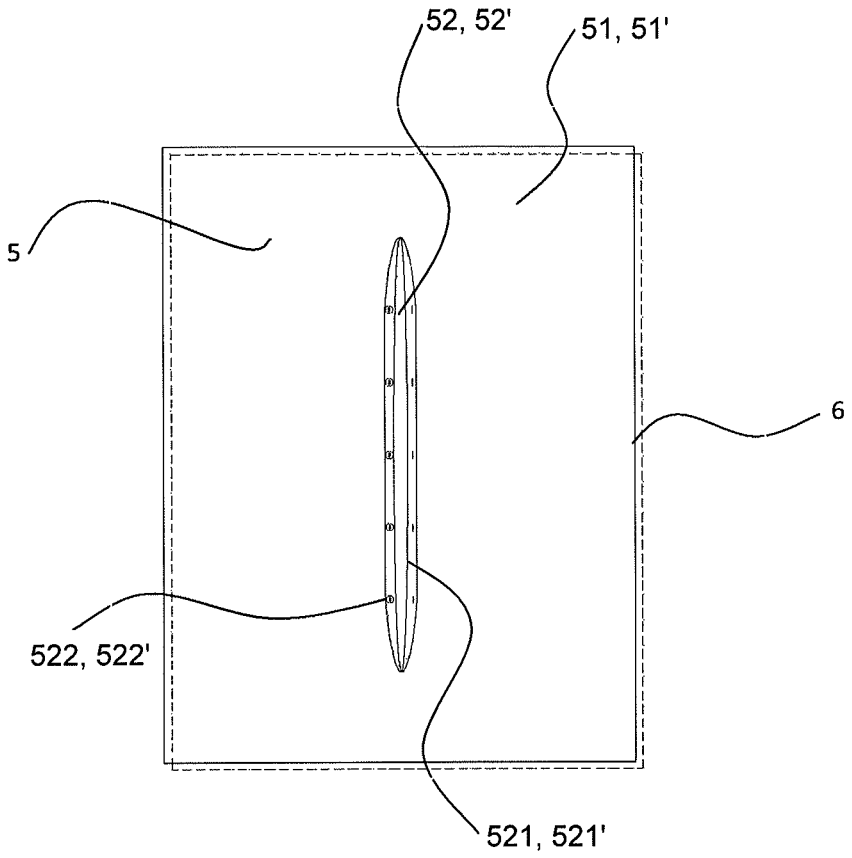
FIG. 2 shows a part of one of the sides of the cover with an example of a mechanism of connection using slits and buttons with reference numerals of elements in the other of the sides of the cover which are identical to elements in the one of the sides of the cover being indicated by the same reference numeral as elements in FIG. 2, but with a prime thereafter.

Blanket 1 consists of two outer textile layers 11, 11' that are made of combed cotton with fine fiber of permanently shiny fiber fabric. Both textile layers have an identically made prolonged opening 2, 2' and they are firmly connected alongside their circumference 3, as well as alongside the circumference 4 of the prolonged opening and by grafting patterns 7.

Example 2

The cover 5 of the blanket 1 consists of two damask layers 51, 51' that are connected alongside their circumference 6. Each one of them contains a prolonged opening 52, 52' with a side adjusted to use for the blanket 1 from example 1. Trimming 521, 521' is created alongside the prolonged opening 52, 52', at the inner sides of the two damask layers 51, 51', with a connecting mechanism 522, 522', i.e. two pairs of slits and buttons.

What is claimed is:

1. A cover for a blanket with protective effect against the dorsal parts of the human body becoming cold during sleep, the blanket comprising two first textile layers of the same size and shape that are equipped with identically located first prolonged openings of the same size and shape and are mutually firmly connected alongside their perimeters and alongside the perimeters of the first prolonged openings, the cover comprising two second textile layers of the same size and shape which are equipped with identically located second prolonged openings of the same size and shape and firmly connected along their perimeters, wherein the second prolonged openings of the second textile layers are equipped in inner sides of the second textile layers with trimming and with a connecting mechanism that mutually connects the openings of the second textile layers or that connects the opening itself of each of the second textile layers.

2. The cover for the blanket according to claim 1, wherein at least one thermal insulation layer of the same size and shape as the first textile layers is located between the first textile layers, the at least one thermal insulation layer being equipped with a third prolonged opening located identically to the location of the first prolonged openings of the same size and shape as the first prolonged openings, and wherein all the layers of the blanket are mutually connected along their perimeters and along perimeters of the first prolonged openings and the third prolonged opening.

3. The cover for the blanket according to claim 1, wherein all layers of the blanket are additionally mutually connected by grafting patterns of regular or irregular shape.

4. The cover for the blanket according to claim 1, wherein pairs of slits and buttons, zips, rivets or hook and loop fasteners are the connecting mechanism.

* * * * *